US009443689B2

(12) United States Patent
Wosgien et al.

(10) Patent No.: US 9,443,689 B2
(45) Date of Patent: Sep. 13, 2016

(54) FUSE

(75) Inventors: Joachim Wosgien, Lohne (DE); Ralf Lange, Horn-Bad Meinberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 297 days.

(21) Appl. No.: 14/239,127

(22) PCT Filed: Aug. 17, 2012

(86) PCT No.: PCT/EP2012/066093
§ 371 (c)(1),
(2), (4) Date: Mar. 19, 2014

(87) PCT Pub. No.: WO2013/024153
PCT Pub. Date: Feb. 21, 2013

(65) Prior Publication Data

US 2014/0218159 A1 Aug. 7, 2014

(30) Foreign Application Priority Data

Aug. 18, 2011 (DE) ..... 10 2011 052 805

(51) Int. Cl.
*H01H 85/143* (2006.01)
*H01H 85/30* (2006.01)
(Continued)

(52) U.S. Cl.
CPC ..... *H01H 85/143* (2013.01); *H01C 7/126* (2013.01); *H01H 37/761* (2013.01); *H01H 85/30* (2013.01); *H01H 85/36* (2013.01); *H01H 85/12* (2013.01); *H01H 85/303* (2013.01)

(58) Field of Classification Search
CPC .... H01C 7/126; H01H 37/761; H01H 85/36; H01H 85/143; H01H 85/30; H01H 85/12; H01H 85/303
USPC ..... 337/206, 218, 219, 239, 244
See application file for complete search history.

(56) References Cited

U.S. PATENT DOCUMENTS 1,501,018 A * 7/1924 Lippincott ..... H01H 85/0458 337/185
1,866,491 A * 7/1932 Schmid ..... H01H 85/303 337/231

(Continued)

FOREIGN PATENT DOCUMENTS

DE 77 19 678 1/1979
DE 195 45 505 C1 6/1995

(Continued)

OTHER PUBLICATIONS

Office Action received in German counterpart application No. 10-2011-052805.9, dated Jun. 4, 2012, 4 pgs.

(Continued)

*Primary Examiner* — Anatoly Vortman
(74) *Attorney, Agent, or Firm* — Knobbe, Martens, Olson & Bear LLP

(57) ABSTRACT

The invention relates to a fuse for connection to a protective component of an overvoltage protective device. A fuse wire runs between a first cap and a second cap. In some implementations, the fuse wire may be held on the first cap by means of a soldered connection and fastened to a connection electrode. The connection electrode may be movable with respect to a fuse body and under mechanical pretension with respect to a fuse body. The fuse wire melts when acted on with a high $I^2t$, and the soldered connection melts upon external heating by the overvoltage protective device above a specified temperature by means of the thermal connection. Electrical contact between the first cap and the connection electrode is broken via the mechanical pretension if the fuse wire or the soldered connection melt.

21 Claims, 6 Drawing Sheets

(51) Int. Cl.

| | |
|---|---|
| ***H01H 85/36*** | (2006.01) |
| ***H01C 7/12*** | (2006.01) |
| ***H01H 37/76*** | (2006.01) |
| *H01H 85/12* | (2006.01) |

(56) References Cited

U.S. PATENT DOCUMENTS

| | | | | | |
|---|---|---|---|---|---|
| 2,296,627 | A * | 9/1942 | Brown | H01H 85/36 | 337/165 |
| 2,313,281 | A | 3/1943 | Taylor | | |
| 2,358,676 | A * | 9/1944 | Wood | H01H 85/36 | 337/182 |
| 2,913,555 | A | 11/1959 | McAlister | | |
| 3,179,774 | A * | 4/1965 | Swain | H01H 85/303 | 337/231 |
| 3,342,964 | A | 9/1967 | Kozacka | | |
| 3,450,949 | A * | 6/1969 | Inglis | H01H 85/306 | 337/244 |
| 3,889,222 | A | 6/1975 | Takano et al. | | |
| 5,014,036 | A * | 5/1991 | Komoto | H01H 9/102 | 337/4 |
| 5,831,507 | A * | 11/1998 | Kasamatsu | H01H 9/10 | 337/299 |
| 6,211,770 | B1 * | 4/2001 | Coyle | H01C 7/126 | 338/101 |
| 6,538,551 | B2 * | 3/2003 | Henricks | H01H 85/0052 | 337/161 |
| 7,724,122 | B2 | 5/2010 | Leach | | |
| 7,864,024 | B2 * | 1/2011 | Schlenker | H01H 37/761 | 337/239 |
| 8,705,221 | B2 | 4/2014 | Daum | | |
| 9,093,203 | B2 * | 7/2015 | Depping | H01C 7/12 | |
| 2013/0033355 | A1 * | 2/2013 | Meyer | H01H 37/761 | 337/147 |
| 2014/0218159 | A1 * | 8/2014 | Wosgien | H01C 7/126 | 337/206 |

FOREIGN PATENT DOCUMENTS

| | | |
|---|---|---|
| DE | 199 17 425 A1 | 10/2000 |
| WO | WO 2010/079015 A1 | 7/2010 |

OTHER PUBLICATIONS

International Preliminary Report on Patentability in related PCT Patent Application No. PCT/EP2012/066093 (with English translation) including Written Opinion (with English translation), dated Feb. 18, 2014, 39 pgs.

International Search Report (with English translation) in related PCT Patent Application No. PCT/EP2012/066093, dated Feb. 21, 2013, 4 pgs.

* cited by examiner

FUSE

CROSS REFERENCE TO RELATED APPLICATIONS

This application is a U.S. National Stage Application of International Application No. PCT/EP2012/066093 filed Aug. 17, 2012, published as WO2013/024153A1, which claims priority from German Patent Application No. 102011052805.9 filed Aug. 18, 2011, which are incorporated herein by reference in entirety.

BACKGROUND

The invention relates to a fuse.

Different embodiments of cap fuses with indicators are known from the prior art. Furthermore, fuses are known that are equipped with spring elements and/or resistor elements integrated on account of power dissipation in order to improve the trip behaviour in the vicinity of the tripping current as a result of inherent heating. These fuses however do not provide a thermal fuse that is independent of current.

In order to overcome thermal problems, different circuits were proposed in the past that have a short-circuit fuse with a thermal cutoff as separate components or independent functional units generally connected in series.

Such devices are complex in terms of design and require a large amount of space. In addition, it is difficult with these arrangements to create a cost-effective display capability that simultaneously provides information for both tripping mechanisms.

The object of the invention is to provide a fuse that, in an inventive manner, avoids one or more disadvantages of the solutions known from the prior art.

Benefits are achieved in accordance with the innovations herein by the features of the presently disclosed implementations. Advantageous embodiments of the invention are also specified in various sub-features herein.

DESCRIPTION OF THE DRAWINGS

The invention will be explained in greater detail hereinafter with reference to the accompanying drawing on the basis of preferred embodiments.

In the drawing

DETAILED DESCRIPTION OF ILLUSTRATIVE IMPLEMENTATIONS

Figure 1:
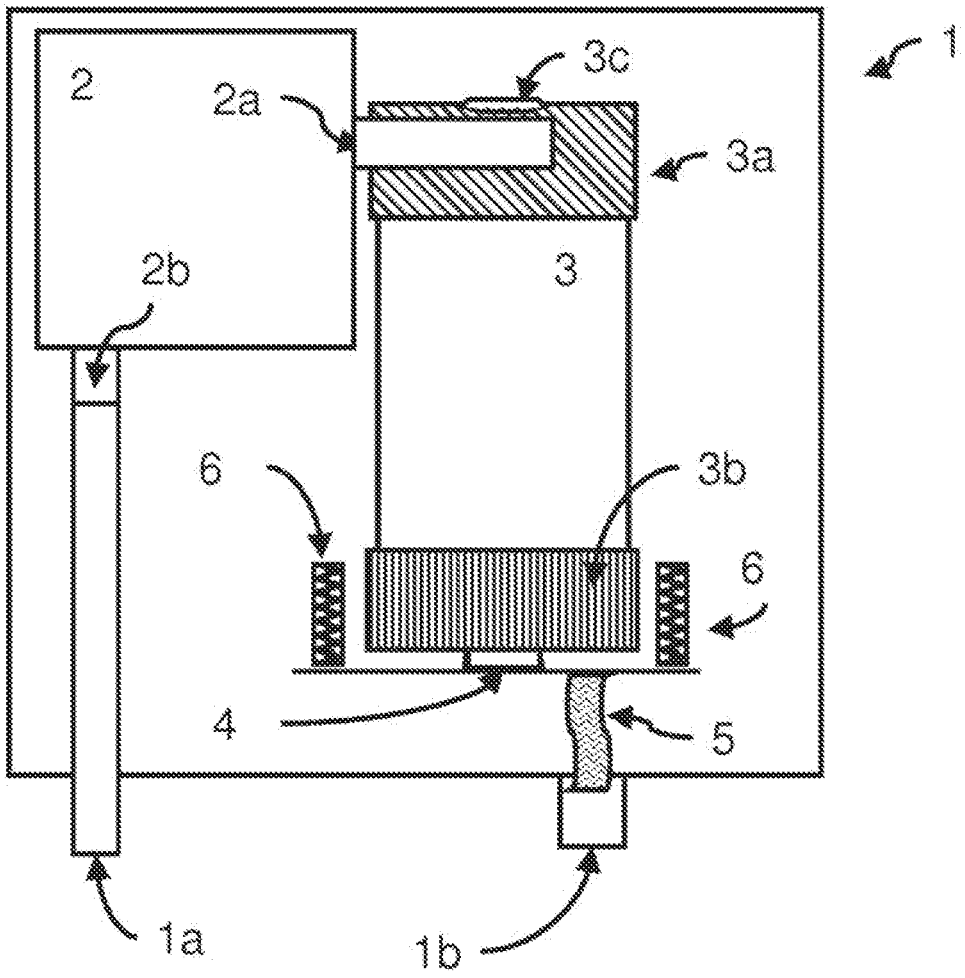
FIG. 1 shows a schematic arrangement of a fuse according to a preferred embodiment of the invention in an overvoltage protective device.

FIG. 1 shows an overvoltage protective device 1 in which a fuse 3 according to the invention can be used. Here, the overvoltage protective device 1 has a protective component 2, for example. The protective component 2 may be a varistor, for example. This protective component 2 has a first connection point 2*a* and a second connection point 2*b*. The connection point 2*b* is electrically connected to the connection point 1*a* of the overvoltage protective device 1, whereas connection point 2*b* is electrically and thermally connected to the cap 3*a* of the fuse 3. The connection electrode 4 is in turn connected by means of a flexible electric connection 5 to the connection point 1*b* of the overvoltage protective device 1. The fuse 3 has a housing 3*f*. This can be fabricated from any suitable material, for example from glass or ceramic, and may have a suitable form, for example a cylinder form. Furthermore, the fuse has the aforementioned first cap 3*a* and a second cap 3*b*. At least the cap 3*a* is electrically and thermally conductive in portions. Furthermore, the fuse 3 has at least one fuse wire 3*d*, which runs within the housing 3*f* between the first cap 3*a* and the second cap 3*b*. During use, the first cap 3*a* is brought into thermal and electrical connection to the protective component 2. Furthermore, the fuse wire 3*d* is held on the first cap 3*a* by means of a soldered connection 3*c*, and the fuse wire 3*d* is also fastened to a connection electrode 4 opposite the first cap 3*a*. The connection electrode 4 is held in a guide 8 in the cap 3*b* so as to be movable with respect to the body 3*f* of the fuse 3 and is under a mechanical pretension 6 with respect to the body 3*f* of the fuse 3. The pretension can be applied, for example, by one or more spring-like elements, without being limited hereto. For example, a repelling magnetic effect could thus alternatively or additionally also provide the corresponding pretension 6.

Figure 2A:
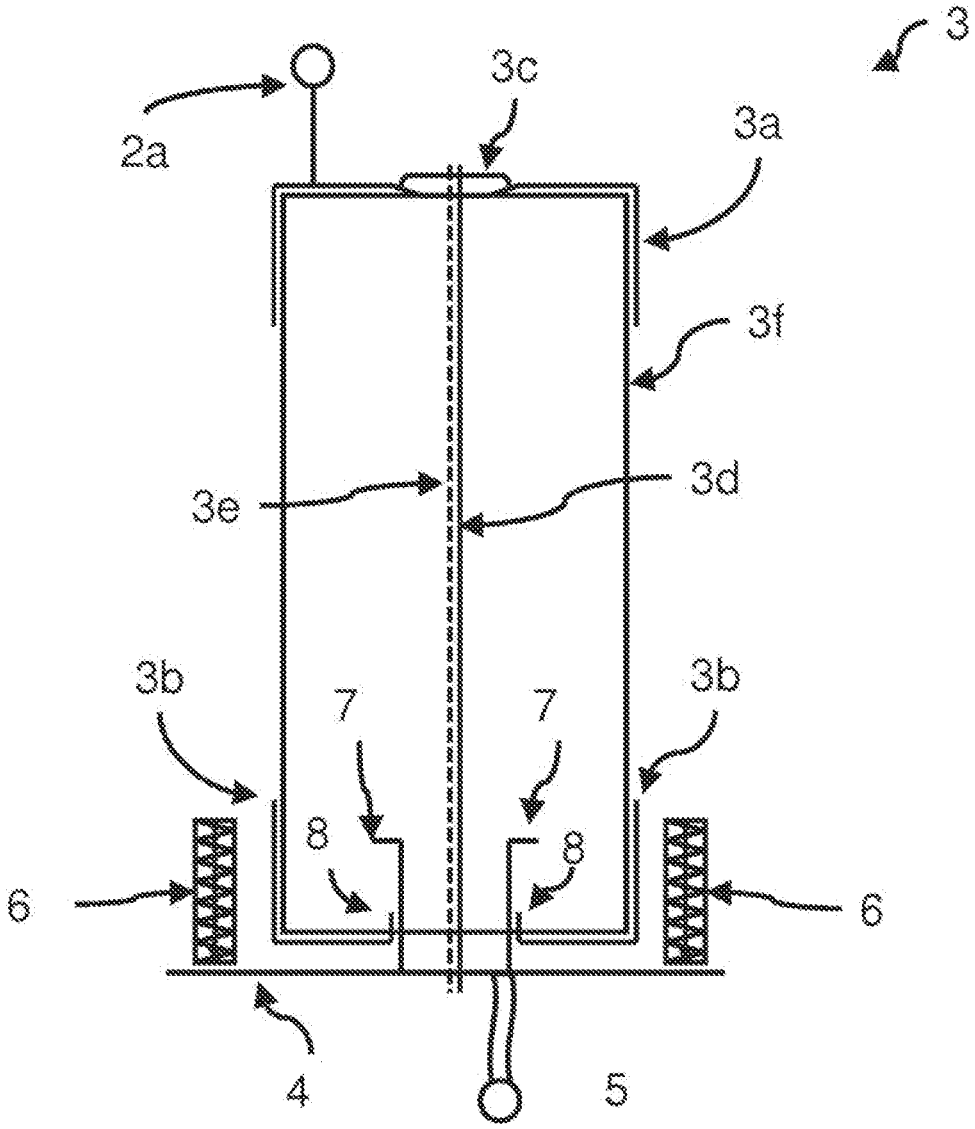
FIGS. 2A and 2B show schematic sectional illustrations according to embodiments of the invention in the untripped state.
Figure 2B:
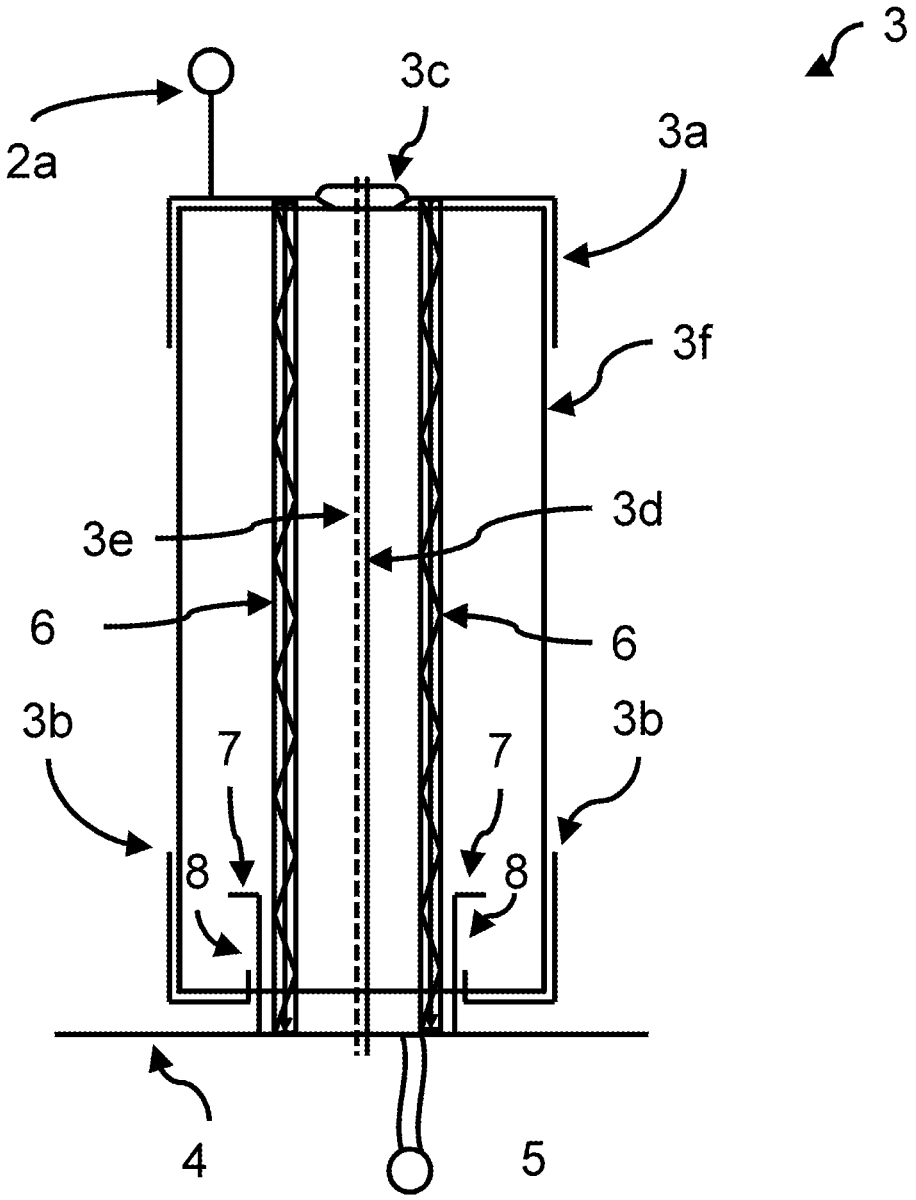
Figure 3:
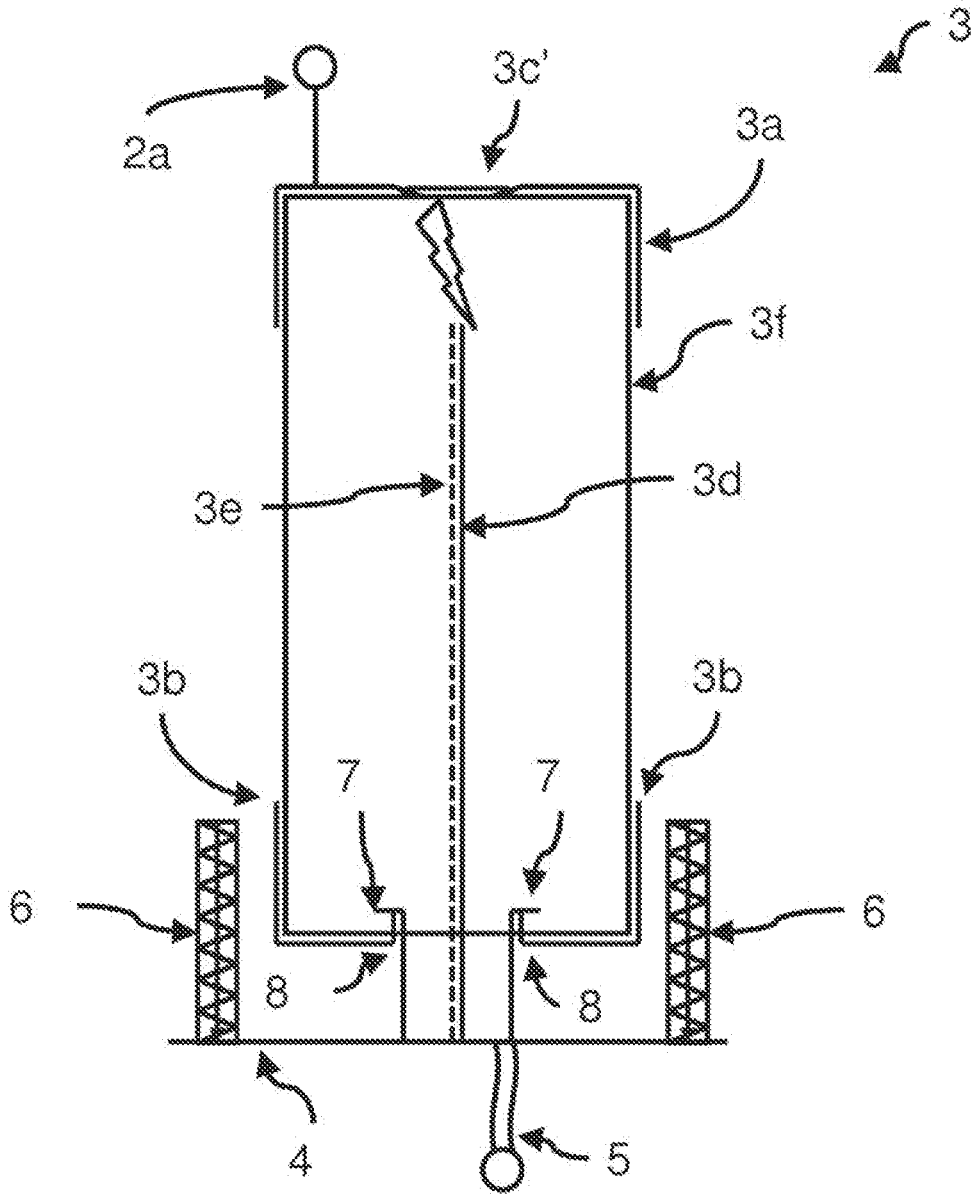
FIG. 3 shows a schematic sectional illustration according to an embodiment of the invention in the tripped state as a result of a thermal event.
Figure 4:
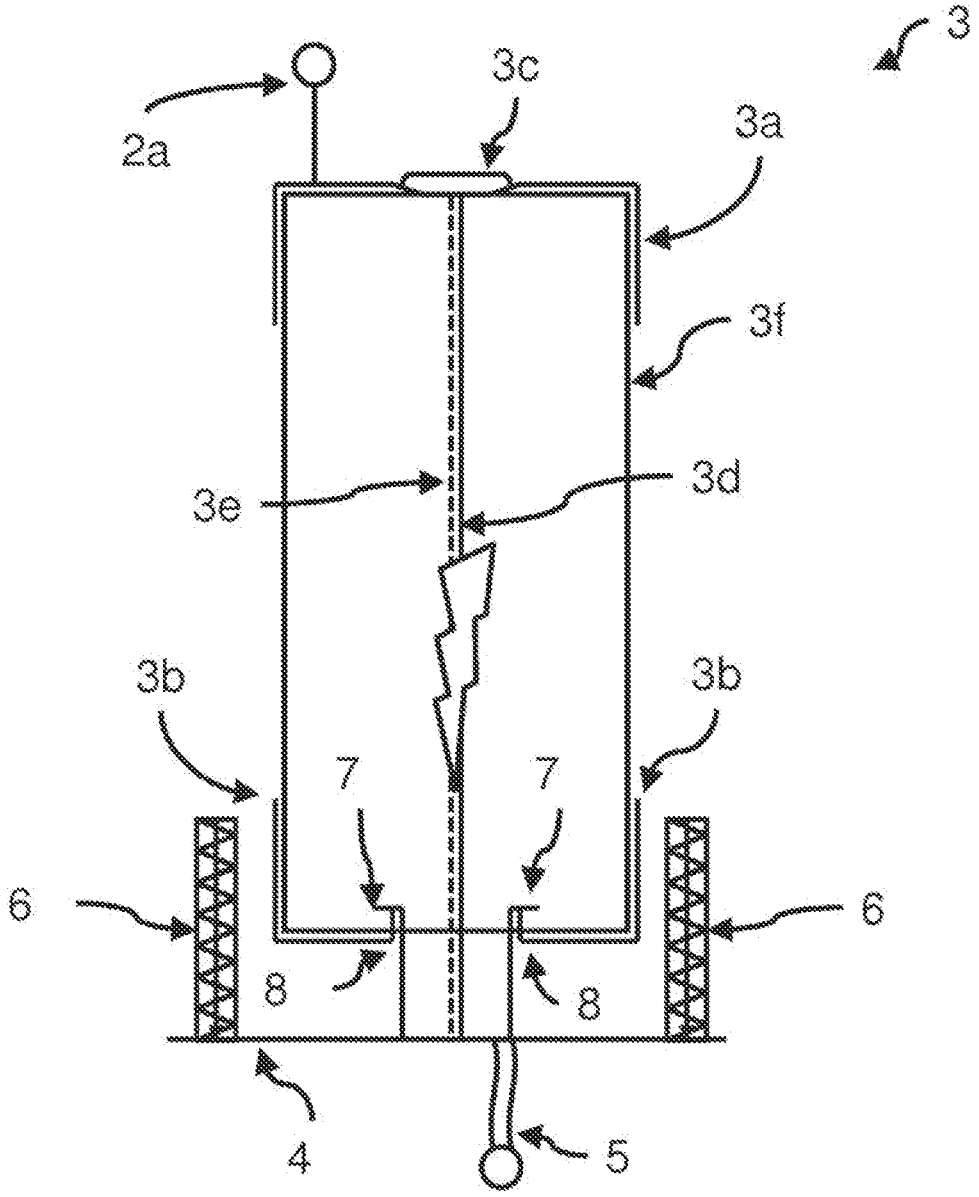
FIG. 4 shows a schematic sectional illustration according to an embodiment of the invention in the tripped state as a result of an event with high $I^2t$.

The fuse wire 3*d* is designed such that it melts when acted on with a high I.sup.2t. Such an I.sup.2t occurs, for example, if a varistor used as a protective component 2 is broken down. Then, a high current flows over a relatively short period of time. In order to prevent this current flow, this large current input is to lead to a melting of the fuse element 3*d* within a relatively short period of time, for example within fractions of seconds. Typical currents that flow in this case lie in the region of 10 amps, 100 amps and more. Such a situation is illustrated in FIG. 4. On the other hand, the fuse wire is also dimensioned such that any pulse current to be carried, for example in the event of a transient event, can be easily carried and removed. Furthermore, the soldered connection 3*c* is designed such that the soldered connection 3*c*, in the event of external heating by the protective component 2 above a specified temperature, melts due to the thermal connection via the connection point 2*a* to the cap 3*a*. Thermal fuse protection of this type is rather slow compared to the melting of the fuse wire and takes between seconds and minutes or more. The core concept is that a slow thermal death of a protective component 2 also leads to tripping of the fuse 3. However, the fuse element 3*d* then will not melt, but instead the soldering point 3*c*. This situation is illustrated in FIG. 3, where the solder of the soldered connection is softened and is denoted by 3*c*' in contrast to FIG. 2A. FIGS. 2A and 2B are schematic sectional illustrations of implementations herein in the untripped state, with FIG. 2A showing a spring arranged externally on the housing, and FIG. 2B showing a spring arranged in the housing. A typical solder that can be used for the soldered connection 3*c* is a suitable low-temperature solder, for example having a soldering temperature of 143.degree. C. or tin solder tubes made of Bi/Pb/Cd or the like. Of course, it is also possible to design the fuse wire 3*d* itself as a soldering point 3*c*.

If the soldering point 3*c* softens or the fuse wire 3*d* melts, the electric contact existing beforehand from the cap 3*a* via the fuse wire 3*d* to the connection electrode 4 is cancelled due to the mechanical pretension 6.

The aforementioned design makes it possible to combine two functions in a single fuse, specifically a thermal fuse and a short-circuit fuse. Due to the property that both functions are combined in a single fuse, the design is small and can additionally be produced cost-effectively.

In an advantageous development of the invention the fuse wire 3*d*, as shown in FIGS. 3 and 4, is moved away from the soldered connection 3*c* into the housing 3*f* as a result of the mechanical pretension 6. It can thus be ensured that a formed arc, which is indicated as a lightning symbol in FIGS. 3 and 4, does not occur outside the fuse, thus ensuring reliability of the fire protection offered.

Furthermore, the housing 3*f* may have a filling, at least in portions, comprising an arc-extinguishing material, such as sand or POM.

Figure 5:
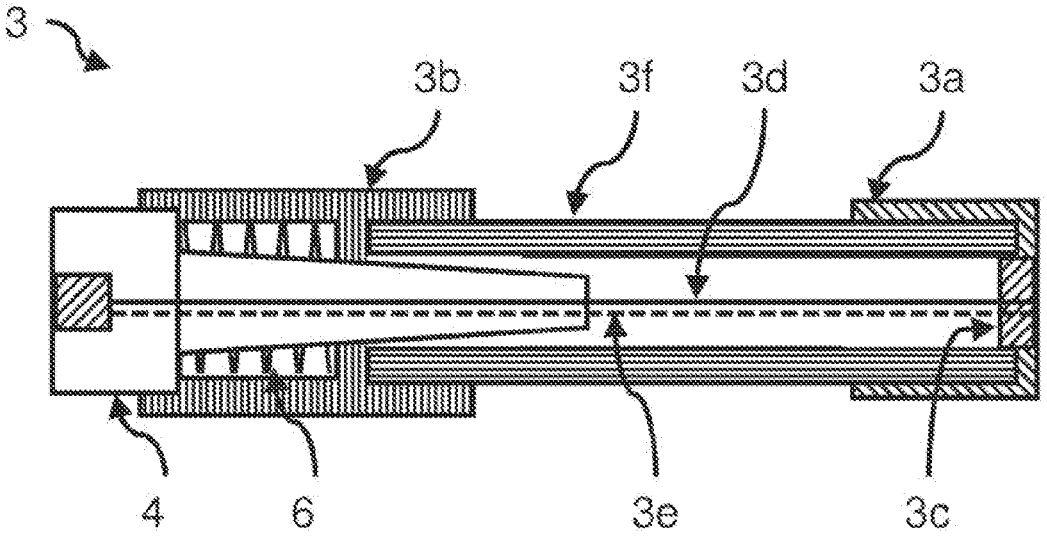
FIG. 5 shows a schematic sectional illustration according to a further embodiment of the invention.

In a further advantageous development of the invention the mechanical pretension 6 is a spring force, wherein the spring(s) is/are arranged either in the housing (as shown in FIG. 5), in particular between the cap 3*b* and connection electrode 4, or (as shown in FIGS. 2, 3 and 4) outside the housing. An arrangement inside protects against contaminations, but has the advantage that the state of the spring cannot be controlled without further measures.

In yet a further advantageous development of the invention a retaining wire 3*e* is guided parallel to the fuse wire 3*d*. This retaining wire 3*e* is highly resistive, in contrast to the fuse wire 3*d*, and is intended to prevent the mechanical pretension 6 from releasing the fuse wire 3*d* prematurely. Due to the highly resistive embodiment with simultaneously greater strength than the fuse wire 3*d*, the current will flow substantially via the fuse wire 3*d*. If this current is too high over a short period of time (high $I^2t$), the fuse wire 3*d* will melt and current will then flow through the retaining wire 3*e*. Due to the higher resistance, it will also melt practically immediately. The fuse wire 3*d* will therefore generally have a high Cu or Al proportion, whereas the retaining wire 3*e* can be fabricated from constantan, for example.

In yet a further advantageous development of the invention the retaining wire 3*e* is electrically and mechanically connected to the connection electrode 4, wherein the fuse wire 3*d* and the retaining wire 3*e* are connected to the electric connection cap 3*a*, arranged opposite, via the soldered connection 3*c*.

In yet a further advantageous development of the invention the fuse 3 further has a display means in order to display the tripping of the fuse. This display may be a mechanical display for example, which is moved with the movable connection electrode 4 and for example provides a colour change from green to red, and/or a switch, for example a microswitch, may be provided which is actuated by the movable connection electrode 4 and closes or opens a corresponding circuit and/or triggers a remote warning.

In yet a further advantageous development of the invention the display means displays the tripping of the fuse 3 if the soldered connection 3*c* melts and also similarly if the fuse element 3*d* melts. Independently of the damaging event, the need to replace the fuse 3 and the associated protective component 2 or, if the fuse 3 is arranged in an overvoltage protective device 1, the overvoltage protective device 1, is thus displayed. The component complexity is thus further reduced and a small overall size is made possible.

In yet a further advantageous development of the invention the movable connection electrode 4 is simultaneously the display means.

In yet a further advantageous development of the invention the movable connection electrode 4 has contact means 7, which are shown in FIGS. 2, 3 and 4, are arranged inside the housing 3*f* and contact the guide 8 inside the housing 3*f* in the event that the fuse 3 is tripped.

In yet a further advantageous development of the invention the movable connection electrode 4 has an extension directed inwardly into the housing 3*f*, wherein the housing 3*f* has a filling, at least in portions, comprising an arc-extinguishing material.

It is thus ensured that any arc formed cannot pass outside.

The objective of the invention is therefore to integrate in the overvoltage protective device 1, besides the thermal fuse (separation device), an additional overcurrent protection means that is adapted to the requirements and to the short-circuit strength of the construction. The objective is achieved by a combination of these two completely different requirements (the thermal separation and the overcurrent separation) in a single component. Such a fuse with "dual function" provides much better protection in various fault situations, on the one hand in the case of small fault currents, which are accompanied by a temperature rise of the protective component (for example: MOV=metal-oxide varistor), and tripping is enabled in the event that a temperature is exceeded, on the other hand in the event of medium and high currents, which may occur if the protective component is overloaded suddenly, thus assuming a low-resistance state. The varistor 2 is in this case usually "broken down" and has reduced power dissipation and therefore generates less heat. Here, the fault current may still adopt very high values however that may correspond to the short-circuit current of the voltage source. Such a fuse therefore requires a switch-off capacity until in the kA range. The "dual function" in a fuse element reduces costs and individual parts, assembly effort, and is suitable for use in order to protect overvoltage protective components 1 in order to meet safety requirements and the requirements as specified in the relevant standards. For suitability in an overvoltage protective device, the transient pulse strength of the selected fuse members has to be particularly high or has to be adapted to the impulse current strength. This generally constitutes a compromise between a necessary minimum strength (that is to say no tripping in the region of the specified pulse current strength of the overvoltage protective device) and reliable and rapid tripping for short-circuit protection or in the event of failure of one of the internal components.

List of reference signs
Key:

| | |
|---|---|
| overvoltage protective device | 1 |
| electric connection points | 1a, 1b |
| protective component | 2 |
| elec. connection points of the protective component | 2a, 2b |
| fuse | 3 |
| cap | 3a, 3b |
| soldered connection | 3c |
| fuse wire | 3d |
| retaining wire | 3e |
| housing | 3f |
| movable connection electrode | 4 |
| flexible electric connection | 5 |
| pretension | 6 |
| contact means | 7 |
| guide | 8 |

The invention claimed is:

1. A fuse for connection to a protective component of an overvoltage protective device, the fuse comprising:

a housing, a first cap, a second cap and a fuse wire, which runs within the housing between the first cap and the second cap, wherein the first cap is thermally and electrically connected to the protective component, wherein the fuse wire is held on the first cap via a soldered connection, wherein the fuse wire is fastened to a connection electrode opposite the first cap, wherein the connection electrode is held in a guide so as to be movable with respect to a body of the fuse and is under a mechanical pretension with respect to the body of the fuse, wherein the fuse wire is designed such that it melts when acted on with a high $I^2t$, wherein the soldered connection is constructed such that the soldered connection, in the event of external heating by the overvoltage protective device above a specified temperature, melts due to the thermal connection, and wherein, due to the mechanical pretension, the electric contact between the first cap and the connection electrode is cancelled if the fuse wire or the soldered connection melt.

2. The fuse according to claim 1, wherein cancellation of the electric contact is caused by moving the fuse wire away from the soldered connection and into the housing as a result of the mechanical pretension.

3. The fuse according to claim 1, wherein the mechanical pretension involves a spring, wherein the spring is arranged either in the housing, or externally on the housing.

4. The fuse according to claim 1, wherein the housing has a filling, at least in portions of the housing, comprising an arc-extinguishing material.

5. The fuse according to claim 1, further comprising a retaining wire guided parallel to the fuse wire.

6. The fuse according to claim 5, wherein the retaining wire is electrically and mechanically connected to the connection electrode, wherein the fuse wire and the retaining wire are connected to the first cap, arranged opposite, via the soldered connection.

7. The fuse according to claim 1, further comprising a display for displaying the tripping of the fuse.

8. The fuse according to claim 7, wherein the display displays the tripping of the fuse if the soldered connection melts and if the fuse element melts.

9. The fuse according to claim 7, wherein a movable connection electrode is simultaneously the display.

10. The fuse according to claim 1, wherein the movable connection electrode has one or more contacts, which are arranged inside the housing and bear against the guide inside the housing if the fuse is tripped.

11. The fuse according to claim 10, wherein the movable connection electrode has an extension guided inwardly into the housing, wherein the housing has a filling, at least in portions of the housing, comprising an arc-extinguishing material.

12. The fuse according to claim 2, wherein the mechanical pretension involves a spring, wherein the spring is arranged either in the housing, in between the first cap and the connection electrode, or externally on the housing.

13. The fuse according to claim 2, wherein the housing has a filling, at least in portions of the housing, comprising an arc-extinguishing material.

14. The fuse according to claim 2, further comprising a retaining wire guided parallel to the fuse wire.

15. The fuse according to claim 14, wherein the retaining wire is electrically and mechanically connected to the connection electrode, wherein the fuse wire and the retaining wire are connected to the first cap, arranged opposite, via the soldered connection.

16. The fuse according to claim 2, further comprising a display for displaying the tripping of the fuse.

17. The fuse according to claim 16, wherein the display displays the tripping of the fuse if the soldered connection melts and if the fuse element melts.

18. The fuse according to claim 8, wherein a movable connection electrode is simultaneously the display.

19. The fuse according to claim 2, wherein the movable connection electrode has one or more contacts, which are arranged inside the housing and bear against the guide inside the housing if the fuse is tripped.

20. The fuse according to claim 19, wherein the movable connection electrode has an extension guided inwardly into the housing, wherein the housing has a filling, at least in portions of the housing, comprising an arc-extinguishing material.

21. The fuse according to claim 1, wherein the fuse wire extends through the first cap and is held at an outer side of the first cap.

* * * * *